US005413300A

United States Patent [19]

Hosteing

[11] Patent Number: 5,413,300

[45] Date of Patent: May 9, 1995

[54] PROFILES FOR SUPPORTING AND MAINTAINING IN TENSION A FALSE CEILING OR A FALSE WALL

[76] Inventor: Guy Hosteing, 1, Clos du Guillan, 33370 Sadirac, France

[21] Appl. No.: 60,043

[22] Filed: May 13, 1993

[30] Foreign Application Priority Data

May 13, 1992 [FR] France ..... 92 06009

[51] Int. Cl.[6] ..... A47H 1/10

[52] U.S. Cl. ..... 248/317; 52/506.06; 52/730.1; 52/731.7; 248/339

[58] Field of Search ..... 248/317, 343, 342, 339, 248/344, 304, 201, 301; 52/506.06, 506.07, 506.08, 731.7, 730.1; 211/94.5, 94

[56] References Cited

U.S. PATENT DOCUMENTS

| | | | |
|---|---|---|---|
| Re. 31,528 | 3/1984 | Mieyal | 52/730.1 |
| 3,034,608 | 5/1962 | Dengler | 52/730.1 |
| 3,201,077 | 8/1965 | Heimann | 248/317 |
| 3,475,869 | 11/1969 | Jahn | 52/731.7 X |
| 3,841,048 | 10/1974 | Jahn | 52/731.7 |
| 4,155,206 | 5/1979 | Player | 52/506.06 |
| 4,197,686 | 4/1980 | Baslow . | |
| 4,771,897 | 9/1988 | Ho | 211/94 |
| 4,811,475 | 3/1989 | Morton, Jr. | 248/317 X |
| 5,090,163 | 2/1992 | New | 52/506.06 X |

FOREIGN PATENT DOCUMENTS

| | | |
|---|---|---|
| 0043466 | 1/1982 | European Pat. Off. . |
| 1475446 | 3/1967 | France . |
| 2078579 | 11/1971 | France . |
| 2310450 | 12/1976 | France . |
| 2597906 | 10/1987 | France . |
| 2627207 | 8/1989 | France . |
| 1150225 | 4/1969 | United Kingdom . |

*Primary Examiner*—Ramon O. Ramirez

*Assistant Examiner*—Korie H. Chan

*Attorney, Agent, or Firm*—Young & Thompson

[57] ABSTRACT

A profile (1) to support and maintain under tension a false ceiling (2) or a false wall constituted by a sheet of plastic material having an integral border (3) forming a hook, the profiles (1) being adapted to be fixed to a ceiling or wall and comprising angle members having a flange presenting a shoulder (4) adapted to receive the border hooked thereover so as to form a throat of U-shaped cross section opening in the direction of another flange of the angle member in which throat the border (3) is to be disposed. There are two such profiles one of which comprises a male profile (1*m*) and the other a female profile (1*f*). The male and female profiles have interengaging structure thereon whereby when interengaged, the profiles form an inverted T having a vertical web adapted to be suspended from a ceiling and whose flanges with the shoulders (4) constitute a horizontal cross member supporting and maintaining in tension a false ceiling. Each of the male and female profiles when disassembled from each other having a vertical web adapted to be secured to a wall to support a false ceiling or false wall. The interengaging structure is engaged over the vertical web of each of the profiles and is constituted by shoulders (5, 6) each forming a throat of U-shaped cross section opening in the direction of the horizontal flange of the male profile (1*m*) and in the opposite direction for the female profile (1*f*). A support spatula for the assembly of such false ceilings or false walls has two flat blades (15, 16) of about the same length and substantially parallel to each other, one of these blades (15) serving to support a said border (3) to maintain in tension a false ceiling or false wall, the other said blade (16) having a hook (17) on a free end thereof and being adapted to fit over said shoulder (4).

10 Claims, 4 Drawing Sheets

PROFILES FOR SUPPORTING AND MAINTAINING IN TENSION A FALSE CEILING OR A FALSE WALL

FIELD OF THE INVENTION

The present invention relates to profiles used to support and maintain and tension a false ceiling or a false wall constituted by a sheet of plastic material.

BACKGROUND OF THE INVENTION

Generally, the sheet of plastic material is stretched between two substantially straight opposite edges, particularly between two walls, to constitute a false ceiling. A sheet of plastic material ordinarily has an integral margin which is both supple and rigid, whose cross section is in the form of a hook that grasps the shoulder provided on the fixed supports secured directly to the wall or against the ceiling.

It is known to use profiles generally of extruded material, as supports comprising a shoulder on which is fixed the margin of the sheet of plastic material, the cross sections of these borders having several variations in their construction, so as to ensure their hooking function. The coaction of the hook constituted by the border, and the shoulder, formed on the profile, permits supporting and maintaining in tension the false ceiling or the false wall.

The principal difficulty involved in the conception and production of the profile and of the integral border of the sheet of plastic material, is the positioning, the hooking and the tensioning of the false ceiling or false wall.

Generally, the material constituting the sheet of plastic material stretches when the temperature rises. For this reason, on the one hand, the size of the false ceiling or false wall is, before installation, slightly less than the finished dimension, and, on the other hand, it is indispensable to heat strongly the false ceiling or false wall in the course of installation, as well as the member in which the one end or the other is to be installed.

The installation conditions are not very comfortable, on the one hand, because of the high temperature of the site, and on the other hand, because the operator, particularly to install a false ceiling, is most often located below this false ceiling to hook it onto the profiles fixed against the walls.

To facilitate the emplacement of the border, certain profiles have a rounded surface such that the border slides before becoming wedged in (FR-A-2 078 579), or cut panels are provided to fulfill an equivalent role, as described in FR-A-2 310 450 and FR-A-2 475 093.

Despite the flexibility of the border, it is generally difficult to engage the lip forming the hook over all the length of the shoulder provided on the profile, such that it is necessary to proceed progressively. To maintain in place the border on a certain section of the shoulder provided on the profile, before proceeding to another section, there are generally provided mortises on this shoulder, so as to limit the length of hooking, and to proceed by stretches of about 20 cm according to FR-A-310 450 or about 12 cm according to FR-A-2 475 093.

To this end, as soon as the first section is engaged, it is indispensable to mark the mortises which are not visible when the operator is situated below the profile. To avoid the need to make a preliminary marking or to proceed by touch, a device comprising a profile with a shoulder without mortises coacts with a border forming a hook on which are provided mortises similar to those provided on the shoulder, as taught by FR-A-2 688 849.

However, these mortises, in addition to the fact that they weaken the profiles or the border, require remachining after extrusion, according to a process generally used. Such an operation is burdensome and substantially increases the cost of the profile or of the border.

Moreover, the profiles are more or less spaced from the surface of the wall on which they are fixed, such that, either their size, or their spacing, is unattractive. To this end, one of the proposed profiles comprises, in its lower portion, a shoulder adapted to cast a shadow and which can serve as an ogee (FR-A-2 078 579).

For aesthetic reasons, it is also possible to position, in the lower part of the profile fixed against the wall, a compensating profile hiding the hook system of the border fixed by jamming between the profile and its shoulder (FR-A-2 624 167).

Generally, to cover all the surface of a ceiling or a wall, the false ceilings and false walls are made in several panels welded together by high frequency current.

When the surface is not too extensive, the tension of the sheet of plastic material is sufficient to avoid the material's own weight, although small per square meter, creating an important sag in the center of the piece.

For large surfaces and to avoid this unsightly sag, it is necessary to fix to the ceiling, at the middle thereof, profiles forming intermediate supports and serving to hook the edges of the two adjacent integral panels with borders forming hooks.

However, the profiles used are generally variations of the profiles serving for the securement against the ceiling and permitting hooking of two edges (FR-A-2 078 579 and FR-A-2 310 450).

The types of profiles serving as intermediate supports, fixed generally to the middle of the construction, can be considered unsightly. To this end, it is proposed to use the junction of the panels to ensure the suspension of the sheet of plastic material from the ceiling. This solution permits moreover mounting a false ceiling according to the shape of the ceiling itself, when this latter is not perfectly horizontal or when its profile is a broken line, particularly for mansard peaks (EP-A-0 13 7 086).

Other solutions require aesthetically securing the false ceiling to the center of the location and provide profiles adapted to be fixed against the wall, the ceiling, or serving at the same time to maintain the border of a false ceiling and of a false wall, thus hiding the profile. To this end, the border is fixed by wedging with the help of a simple spatula, masks or decorations being fixed by clips on the profiles (EP-A-0 338 925).

All the profiles proposed are generally cumbersome, either because they require machining to effect a mortise necessary for emplacing the false ceiling or false wall, or because they are provided each for a specific use, such that it is necessary to store several types of profiles for a predetermined use. To provide profiles at reasonable price, most builders use profiles of plastic material. These profiles, weakened by the mortises, are less rigid than the profiles extruded from light metal. Moreover, their painting is difficult because it does not cling to the plastic and requires repainting because of flaking accidentally happening during adjustments necessary for installation.

No matter what the system of hooking of the border that is used, using a hook and mortises or a system of jamming on the shoulder, the operation of installation remains delicate because of the fragility of the sheet of plastic material and also because of the conditions of installation, most often high overhead and at elevated temperature.

Moreover, from a decorative standpoint it may be interesting to combine these types of false ceilings or false walls with ceiling or wall portions constituted by panels or sunken panels of different materials, such as linings or mirrors, or different uses, such as lights. The profiles dedicated to the false ceilings and false walls generally are not adaptable for such use.

Without changing the conditions of installation, the present invention proposes to facilitate them and to overcome the drawbacks recited above.

SUMMARY OF THE INVENTION

To this end, the invention has for its object profiles to support and maintain in tension a false ceiling or a false wall constituted by a sheet of plastic material integral with a border forming a hook, said profiles, fixed to the ceiling or wall, being constituted by angle members of which a flange has a shoulder adapted to hook the border, so as to form a throat of U-shaped cross section open in the direction of the other flange or web of the angle in which is disposed the border, which overcomes the drawbacks of the prior art cited above.

According to the invention, the profiles comprise interengaging means of the one constituting the male portion with corresponding means on the other constituting the female portion, so as to form an inverted T-shaped profile, whose vertical web thus obtained is suspended from the ceiling and whose flanges of the T, constituting the shoulders, constitute a horizontal crosspiece supporting and maintaining in tension the false ceiling and, disassembled, each of the male or female profiles constitutes assembly means permitting the construction of a continuous corner border to support and maintain in tension a false ceiling or a false wall, to be hooked on the shoulder of one or the other of the profiles, by means of the integral border of the sheet of plastic material, requiring the coaction of support spatulas comprising at least one hook.

Preferably, the interengaging means provided on the vertical web of each of the profiles are constituted by shoulders forming each a throat of U-shaped cross section open in the direction of the horizontal flange for the male profile and opening in the opposite direction for the female profile, such that these shoulders interconnect said profiles thereby forming an inverted T profile.

According to a preferred embodiment of the invention, the upper edge of the vertical web of the female profile comprises a shoulder adapted to form a throat of U-shaped cross section, terminating in a free edge offset with respect to the vertical web of which it is the prolongation, this cross section being open in the direction of the horizontal flange of the profile.

Preferably, the upper edge of the vertical web of the male profile comprises a projection, adapted to be laterally immobilized after having been introduced swingingly and then slidably downwardly within the shoulder at the end of the vertical web of the female profile.

Thus, the shoulder provided on the vertical web of the female profile permits the encasement of the male profile in the female profile. To bring about this encasement, if it is supposed that the female profile is stationary, it suffices to present the vertical web of the male profile slightly inclined toward the throat of the vertical end of the female profile, to introduce its end in the throat, then to swing the male profile to the vertical. The shoulders provided on the vertical web of each of the profiles are then in engagement position. It suffices to slide the male profile downwardly to effect the encasing of the shoulders, the projection of the end of the vertical web of the male profile coming to bear against the shoulder at the end of the vertical web of the female profile. The profiles are then encased and immobilized with respect to each other to form a crosspiece permitting supporting and maintaining in tension the false ceiling.

These profiles are suspended by means of a bracket or a clip bearing on the shoulder of the vertical web of the female profile and connected to the ceiling by a chain or a cable.

Any other means can be used, particularly by piercing the upper portion of the shoulder so as to secure a tongue connected to the ceiling.

According to another characteristic of the invention, each of the external surfaces of the shoulders provided on the vertical webs of the profiles is located in a plane permitting the securement of the profiles against a wall or against a ceiling.

According to another characteristic of the invention, the assembly means, provided on each of the internal surfaces of the vertical webs of the profiles, are constituted at the same level relative to the horizontal flange of the profile, by grooves serving as slideways for a cross member adapted to maintain assembled the different portions of the profiles disposed end-to-end to form an angle between them.

Preferably, the profiles are rectilinear and permit effecting assembly of modules and/or sunken panels of different geometries.

The shoulders provided on each of the profiles have sufficient surfaces to serve for bearing and securement against the ceiling or the wall.

Moreover, the grooves provided on the internal surface of each of the profiles permit joining them endwise to each other more easily or to connect them at angles depending on the shape of the ceiling or the walls.

However, the abutment of the sections by means of an interconnection introduced into the grooves is not possible unless effected between the same category of male-male profiles or female-female profiles. Thus, the grooves located on the same level relative to the horizontal web are not coincident with the bearing surfaces of the vertical webs.

On the contrary, the connection of a male-female angle is possible with the aid of an interconnecting member bent to the angle of the bearing surfaces. This connection requires cutting different angles on the horizontal flanges of each of the profiles. Under these circumstances, it is possible to effect any polygonal geometric shape such as a rectangle, a lozenge, a trapezoid, or even irregular shapes. The shapes constitute modules or sunken panels emplaceable within each other.

It is moreover easy to provide surfaces comprising at the same time panels of stretched sheet material and panels comprising rigid coverings, such as panels, mirrors or other decorative items. The production of these modules or sunken panels can be effected preliminarily to their encasement, when constructing a same row of panels. Beyond that, it is necessary to proceed with the encasement of the male-female profiles, then to install on each module or sunken panel, either the sheet of plastic material, or else any other rigid covering.

It is also possible to assemble the panels in diagonal opposition. To this end, it suffices to make sure that along a common line there will be only profiles of the same category, namely male or female, such that interconnection will be possible.

According to another characteristic of the invention, the profiles can be arched in the plane of the vertical web so as to form domes, or integrated and arched according to the plane of the horizontal flanges for the production of flat curves.

Thus it is possible to obtain complex panel shapes, so as to provide curvatures compatible with the mechanical resistance of the materials used to fabricate the profiles. As a result, a hemispheric dome with cut panels can be formed from these profiles.

The invention also has for its object support spatulas, for the assembly of false ceilings or false walls, coacting with the shoulder of one or the other of the profiles and the border forming a hook, characterized in that it comprises two flat blades of approximately the same length and substantially parallel, of which one serves to support the border forming a hook by maintaining in tension the false ceiling or the false wall, and of which the other is engaged over the shoulder of the profile with the aid of a hook of U-shaped cross section open toward the exterior and in the direction of the handle of the spatula, the ridges of said blades being rectilinear or forming an angle near that formed by the profiles with each other, on the shoulders of which the borders become hooked.

The omission of mortises, effected on the shoulder of the profile or on the edge according to the prior art, requires the use of the support spatulas in combination with ordinary spatulas.

Several bilaminar spatulas with rectilinear ridges and with ridges forming an angle between them are necessary to effect the emplacement of a false ceiling or a false wall.

The sheet of plastic material is maintained in the stretched position with the aid of these spatulas above the shoulder of the horizontal flange of the profile. The installation is effected by causing to slide, with the aid of an ordinary spatula, the lips of the border of the sheet of plastic material, maintained stretched by the spatulas according to the invention, onto the shoulder of the horizontal flange of the profile.

To anchor the border, the support spatulas are removed. Thus, not only is the installation facilitated but also the installation itself is easy and rapidly executed.

BRIEF DESCRIPTION OF THE INVENTION

The invention will be better understood from the following description, which relates to a preferred embodiment, given by way of non-limiting example, and explained with reference to the accompanying schematic drawings, in which:

FIG. 1 is a cross-sectional view of profiles according to the invention in the interengaged position;

FIGS. *2a* to *2c* are fragmentary cross-sectional views of profiles in the course of interengagement;

FIG. 3 is a schematic cross-sectional view of different modules according to the invention;

FIGS. 4*a* to 4*c* are schematic views of embodiments of geometric figures obtained by the aid of the profiles;

FIG. 5 is a fragmentary perspective view from above of the production of a dome;

FIGS. 6*a* and 6*b* are schematic views showing the emplacement of a false ceiling with the aid of support spatulas; and FIGS. 7 and 8 are plan views, on a larger scale, of support spatulas.

DETAILED DESCRIPTION OF THE INVENTION

In the accompanying drawings and in the description which follows, the indices m and f indicate for the profiles according to the invention that they are respectively male profiles (m) or female profiles (f).

Figure 1:
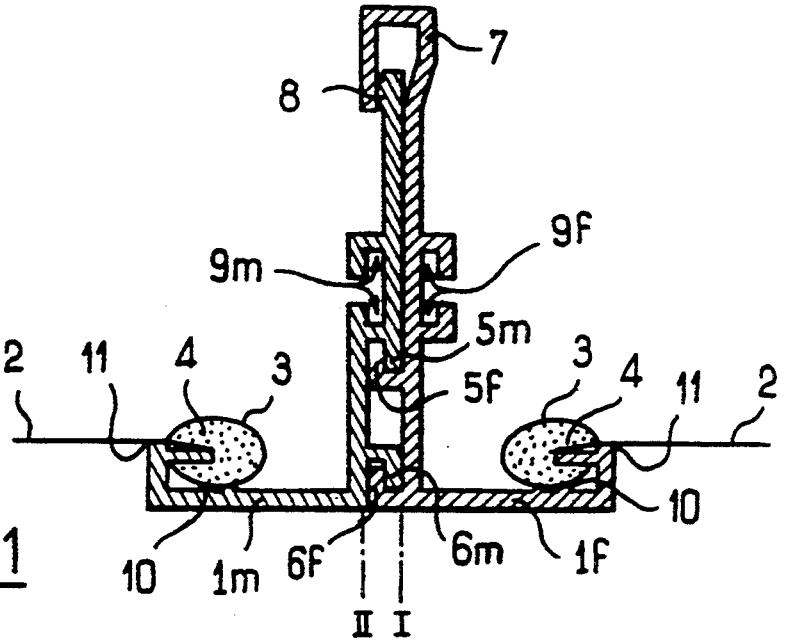
Figure 2A:
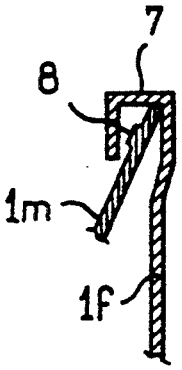
Figure 2B:
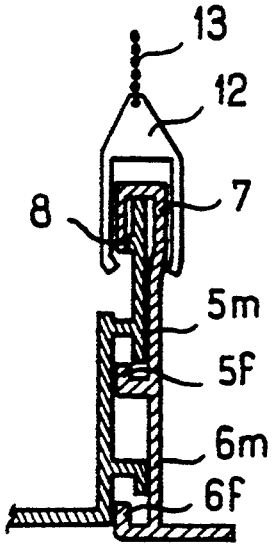
Figure 2C:
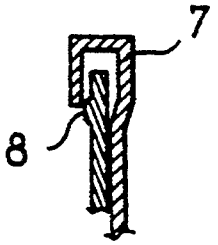

FIG. 1 of the accompanying drawings shows profiles 1*m* and 1*f* interengaged with each other by means of shoulders 5 and 6 formed on the external surface of the vertical web of each of the profiles.

The upper end of the vertical web of the male profile 1*m* is provided with a projection 8 bearing on the corresponding shoulder 7 of the female profile 1*f*, so as to be laterally immobilized.

Grooves 9 provided on the internal surface of each of the profiles 1*m*, 1*f* serve as slideways for crosspieces constituted by blades or angle pieces as a function of the connection of the profiles to be effected, namely an end connection or with the provision of an angle. The crosspiece is introduced at the outset into the groove 9 of a profiled section, then a second section is threaded on this crosspiece, whether this latter is rectilinear or angled. The crosspiece is immobilized in its groove by two set screws.

The internal surface of the horizontal flange is provided with fine grooves 10 like sawteeth adapted to hook the border when it is placed on the shoulder 4 of the profile. For aesthetic reasons, the vertical portion of the shoulder 4 is provided with a projection 11 prolonging this latter and constituting a sharp ridge on which rests the sheet of plastic material or other material employed to produce a module.

FIGS. *2a* to *2c* show, in fragmentary cross sectional views, the end of the vertical webs of the profiles in the course of three phases of interengagement.

In FIG. *2a*, the vertical end of the male profile 1*m* is inclined and inserted in the throat of the shoulder 7 at the upper end of the female profile 1*f*. When the end of the male profile abuts the interior of the throat, the male profile is swung toward the female profile.

The second assembly phase, shown in FIG. *2b*, shows the position of the two profiles after swinging of the male profile 1*m*. The shoulders 5*m* and 5*f*, as well as 6*m* and 6*f*, are in engaged position. The projection 8 of the male profile bears against the internal surface of the shoulder 7 of the female profile.

This figure also shows a bracket 12 bearing on the shoulder 7 of the vertical web of the female profile. A small chain 13 permits suspending the profiles interengaged with each other. It thus suffices to slide downwardly the male profile until the shoulders 5 and 6 are interengaged, the projection 8 then bearing on the internal surface of the shoulder 7, as shown in FIG. *2c*.

Figure 3:
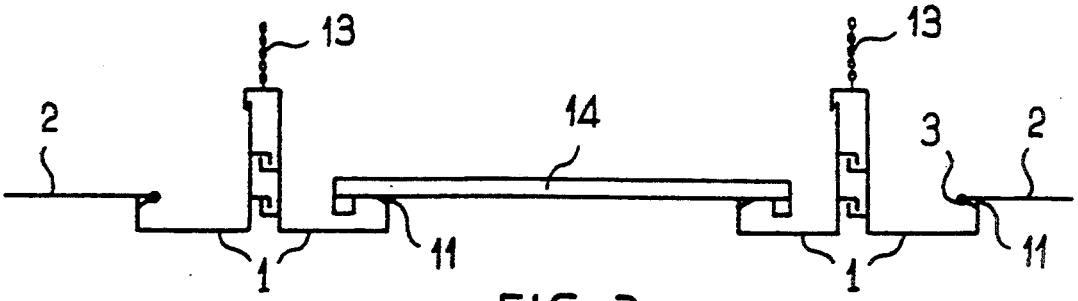

FIG. 3 shows, in a schematic cross-sectional view, a false ceiling constituted by several panels. This false ceiling has at its center a rigid panel 14 of finishing material or any other decorative material, which rests on ridges 11 of the profiles. From each side of said panel is stretched a false ceiling constituted by sheets 2 of plastic material.

Figure 4A:
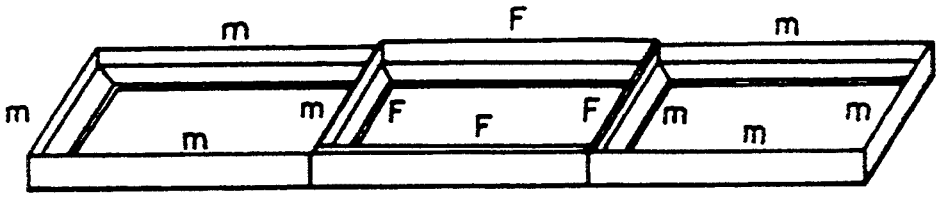
Figure 4B:
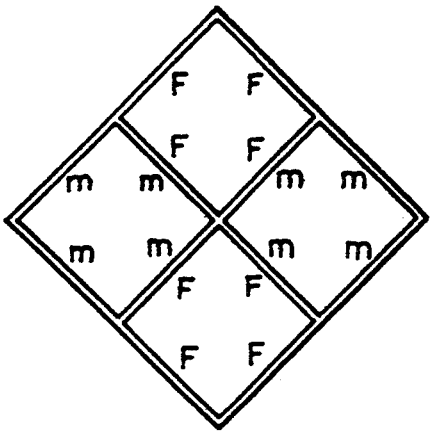
Figure 4C:
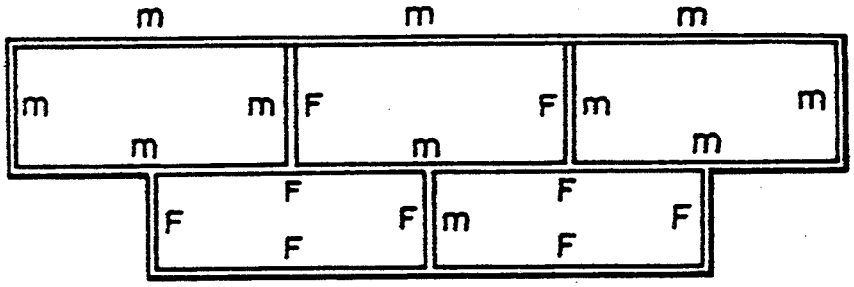

FIGS. 4*a* to 4*c* show schematically embodiments of different geometric figures obtained with the help of the profiles. Thus, FIG. 4*a* shows an assembly of three sunken panels produced with the help of a combination of profiles. At the center, one sunken panel is provided with female profiles 1*f*, sunken panels produced with male panels 1*m* interengaging with each other. These sunken panels can receive different coverings such as shown in FIG. 3, namely, for example, a central rigid panel and a false ceiling stretched from opposite sides of this central panel. In this case, it is possible to provide preliminarily the panels before mounting them by interengagement of the profiles.

FIG. 4*b* shows lozenge-shaped sunken panels. To this end, it suffices that the junction of the lozenges between themselves and the male profiles 1*m* will be associated with female profiles 1*f* for their interengagement.

FIG. 4*c* shows that it is also possible to provide, with the help of profiles according to the invention, an arrangement of diagonally arranged panels. Thus, in a same junction line are disposed profiles of the same type, namely for example male profiles 1*m*, with which interengage female profiles 1*f*.

Figure 5:
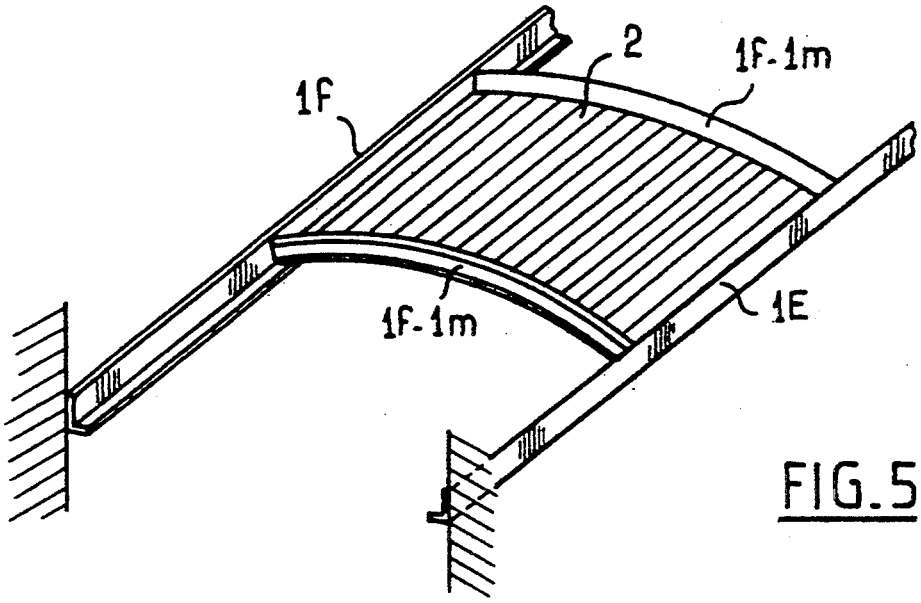

FIG. 5 shows the embodiment of a dome with the help of profiles 1*f* and 1*m* arched in the plane of the vertical web. These profiles bear on profiles 1*f* forming corners of the edges and fixed to the wall.

A false ceiling of sheet plastic material 2 is stretched between the arched profiles. Other panels, not shown, are fixed on opposite sides of this portion of the false ceiling.

Figure 6A:
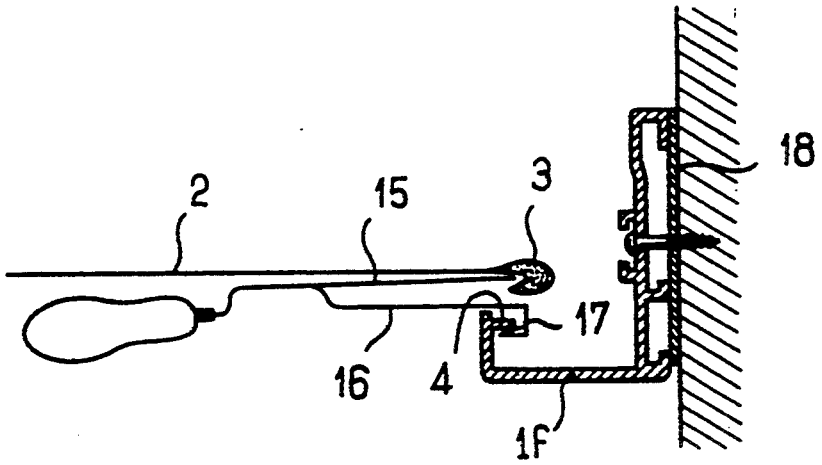

FIG. 6 shows schematically in cross section the assembly of a false ceiling constituted by a plastic sheet 2. One of the profiles 1*f* is fixed against a wall by screws positioned between the slideways and shims 18 about 1 mm thick are interposed between the wall and said profile so as to ensure ventilation above the false ceiling. The emplacement of the false ceiling, before installation, is effected in several stages. The first stage consists in emplacing a border on the shoulder 4 of the profile 1*f*, the false ceiling not being stretched. This step is relatively easy. The second step consists in heating the false ceiling and the backing with the help of a heat blower adapted to increase the dimensions of the false ceiling, so as to permit its installation.

To carry out the third step, the invention uses support spatulas 15, 16, 17, coacting with the shoulder of one or the other of the profiles and the border 3 forming a hook, these spatulas comprising two flat blades 15 and 16 approximately of the same length and substantially parallel, of which one 15 serves to support the border 3 forming the hook by maintaining in tension the false ceiling or the false wall, and of which the other 16 interengages with the shoulder 4 of the profile with the help of a hook 17 of U-shaped cross section opening toward the outside and in the direction of the handle of the spatula, the ridges of said blades being straight or forming an angle similar to that formed by the profiles between each other, on the shoulders 4 on which will be hooked the borders 3 (FIGS. 6*a* to 8).

This third step begins by hooking the border 3 on the blade 15 of the support spatula 15, 16, 17, then, by pushing on the spatula, the false ceiling is emplaced under tension.

After sufficient heating, it is impossible to engage the hook 17 of the second blade 16 of the spatula over the shoulder 4 of the profile 1*f*. The two blades 15 and 16 have a width of about 80 mm and are spaced apart from each other by approximately 8 mm.

It is preferable to use support spatulas 15, 16, 17 in the first step of installation.

The use of several support spatulas permits completely stretching the false ceiling in a ready position before its securement on the profiles 1*f*.

Figure 6B:
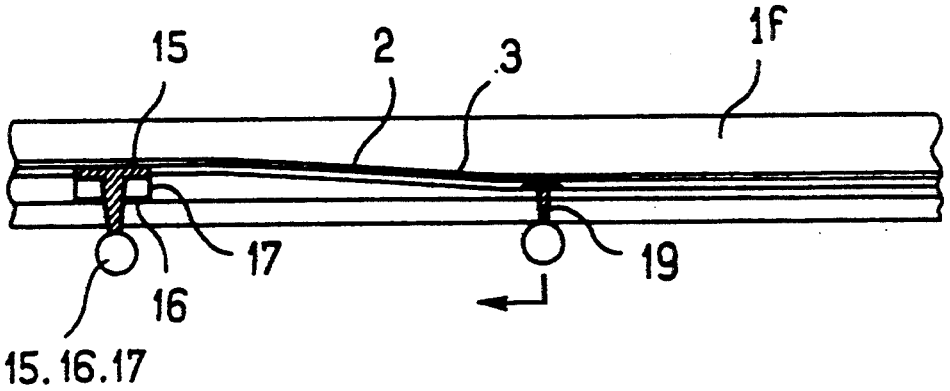
Figure 8:
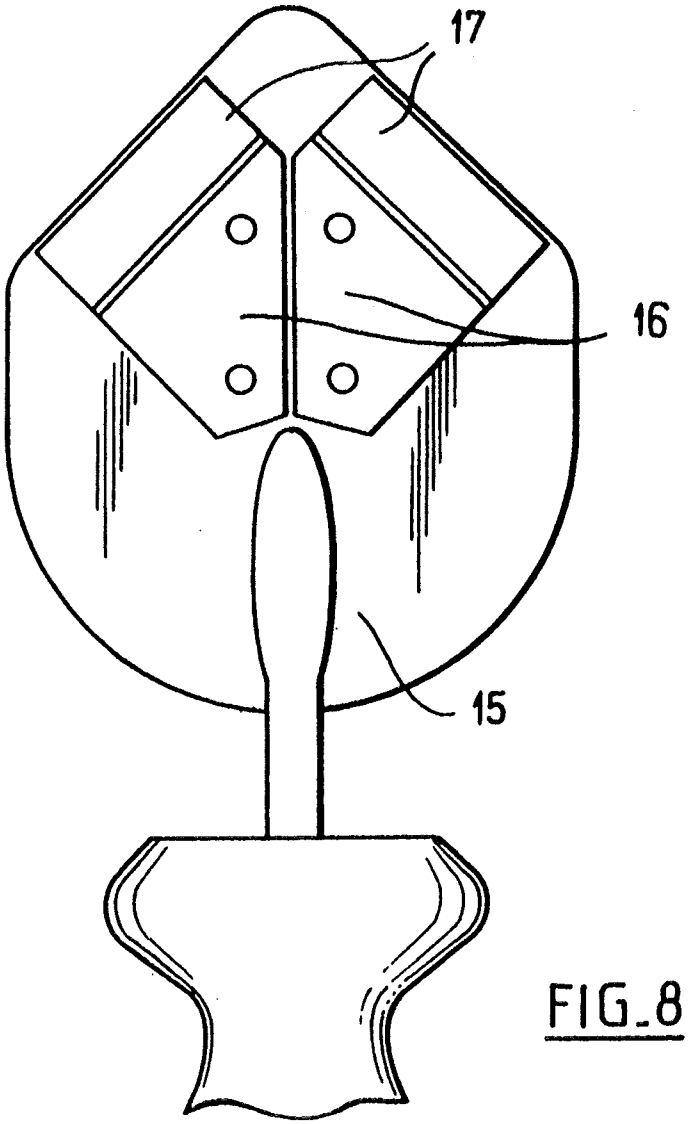
Figure 7:
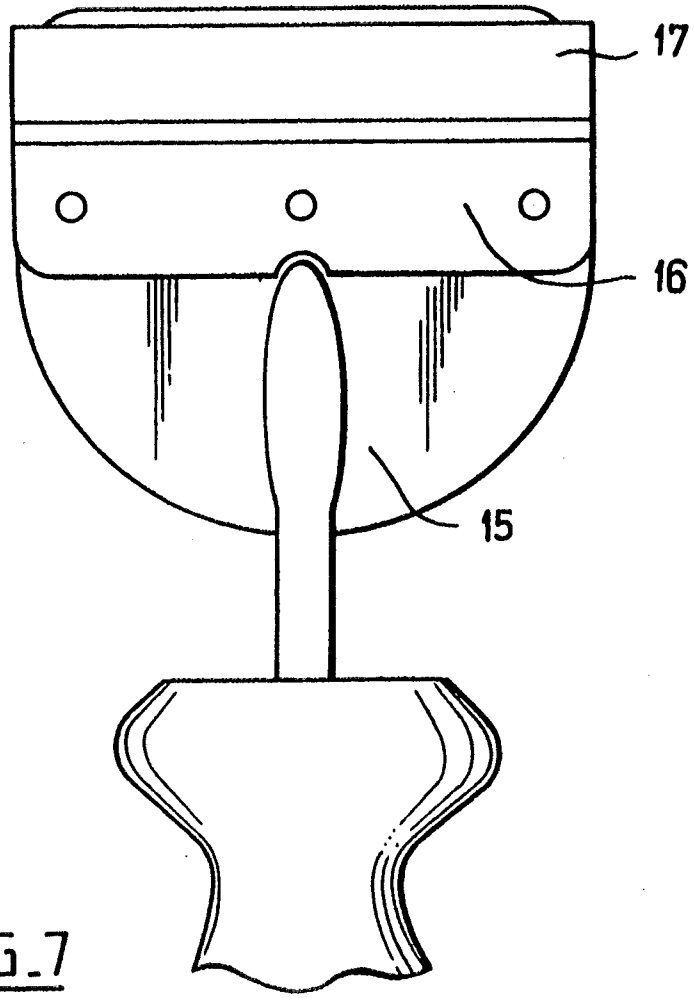

FIG. 6*b* shows the second step of installation in a fragmentary front view of the profile 1*f*, the support spatula 15, 16, 17 being fixed on the shoulder 4 of the profile. So as to cause the border 3 on the blade 15 to pass the shoulder 4, it suffices to slide an ordinary spatula 19, whose blade is placed between the lips of the border 3. One proceeds thus section by section, by pushing or raising each time the support spatula 15, 16, 17. Preferably, the hooking is effected beginning at the corners of the room, with the aid of a support spatula such as shown in FIG. 8 of the accompanying drawings.

Thanks to the invention, it is possible to effect the installation of a false ceiling or a false wall in an easy and rapid manner, rendering the conditions of installation, at elevated temperature, easier to maintain.

Moreover, the profiles according to the invention permit the production of numerous geometric forms. Moreover, in the case of an embodiment of these profiles in extruded light metal, they can be easily painted or lacquered. Thus, architects have available multiple and varied means, which, combined with a wide range of colors, permits providing large wall or ceiling surfaces giving free rein to their imagination.

Of course, the invention is not limited to the embodiments described and shown in the accompanying drawings. Modifications remain possible, particularly as to the constitution of various elements or by substitution of technical equivalents, without thereby departing from the scope or protection of the invention.

What is claimed is:

1. In a profile (1) to support and maintain under tension a false ceiling (2) or a false wall constituted by a sheet of plastic material having an integral border (3) forming a hook, said profile (1) being adapted to be fixed to a ceiling or wall and comprising angle members having a first horizontal flange including a shoulder (4) adapted to receive said border hooked thereover so as to form a throat of U-shaped cross section opening in the direction of a second flange of the angle member in which throat said border (3) is to be disposed; the improvement wherein there are two said profiles one of which comprises a male profile (1*m*) and the other a female profile (1*f*), said male and female profiles having interengaging means thereon whereby when interengaged, said profiles form an inverted T having a vertical web adapted to be suspended from a ceiling and whose first flanges with said shoulders (4) constitute a horizontal cross member supporting and maintaining in tension a false ceiling, each said male and female profile when disassembled from each other having a vertical web adapted to be secured to a wall to support a false ceiling or false wall.

2. Profile according to claim 1, wherein the interengaging means are provided on the vertical web of each of the profiles and include shoulders (5, 6), each of these shoulders forming a throat of U-shaped cross section opening in the direction of the horizontal flange for the male profile (1) and in the opposite direction for the female profile (1*f*).

3. Profiles according to claim, wherein the vertical web of the female profile (1*f*) has an upper end which comprises a U-shaped shoulder, said U-shaped shoulder defining a throat that opens downwardly.

4. Profiles according to claim 3, wherein an upper portion of the vertical web of the male profile (1*m*) comprises a protrusion (8) which bears against a downwardly projecting portion of the U-shaped shoulder (7) of the female profile (1*f*) and is adapted to be inserted in the throat of said u-shaped shoulder (7) by upward movement, followed by downward movement to interengage the male and female profiles.

5. Profiles according to claim 2, wherein all external surfaces of the shoulders (5, 6) of the interengaging means are located in planes permitting the securement of each of the profiles against a flat wall or a flat ceiling.

6. Profiles according to claim 1, wherein assembly means are disposed on confronting surfaces of the vertical webs of the profiles and comprise grooves (9) serving as slideways for an interconnecting member adapted to maintain assembled various portions of profiles disposed end-to-end or forming an angle between themselves.

7. An assembly of modules comprising a plurality Of profiles according to claim 1, wherein said profiles are rectilinear.

8. An assembly of modules comprising a plurality of profiles according to claim 1, wherein said profiles are arched so as to form a dome.

9. An assembly of modules comprising a plurality of profiles according to claim 1, wherein said profiles are disposed in a curved plane.

10. A spatula for the assembly of a false ceiling or false wall using profiles according to claim 1, said spatula comprising two flat blades (15, 16) of about the same length and substantially parallel to each other, one of said blades (15) serving to support a said border (3) to maintain in tension a false ceiling or false wall, the other of said blades (16) having a hook (17) on a free end thereof and being adapted to fit over said shoulder (4).

* * * * *